United States Patent [19]

Coquerel

[11] 4,305,553

[45] Dec. 15, 1981

[54] FLEXIBLE HOSE AUTOMATIC WINDING DEVICE

[76] Inventor: Michel J. L. Coquerel, Villa "Le Havenet", 14 Villerville, Calvados, France

[21] Appl. No.: 86,706

[22] Filed: Oct. 22, 1979

[51] Int. Cl.[3] ..... B65H 75/48

[52] U.S. Cl. ..... 242/86; 137/355.25; 242/107

[58] Field of Search ..... 242/86–86.4, 242/107, 100.2; 137/355.12, 355.19, 355.23, 355.25, 355.26, 355.27

[56] References Cited

U.S. PATENT DOCUMENTS

| | | | |
|---|---|---|---|
| 1,499,644 | 7/1924 | Dowrelio | 242/86 |
| 2,174,099 | 9/1939 | Vogler et al. | 242/86 |
| 2,577,859 | 12/1951 | Schirmer | 242/86 X |
| 2,907,534 | 10/1959 | Benstein | 242/86 |
| 3,225,974 | 12/1965 | Athas | 242/86 X |

FOREIGN PATENT DOCUMENTS

| | | | |
|---|---|---|---|
| 492617 | 2/1930 | Fed. Rep. of Germany | 242/86 |

*Primary Examiner*—John M. Jillions
*Attorney, Agent, or Firm*—Hauke and Patalidis

[57] ABSTRACT

An automatic winding or retracting device for the flexible hose of a gasoline or other petroleum product supply unit. The device comprises a drum for the flexible hose, the drum being connected to a pulley on which is wound a cable connected to a tensioning mechanism.

9 Claims, 6 Drawing Figures

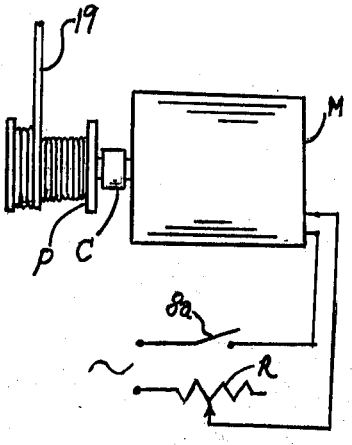
Fig. 1a
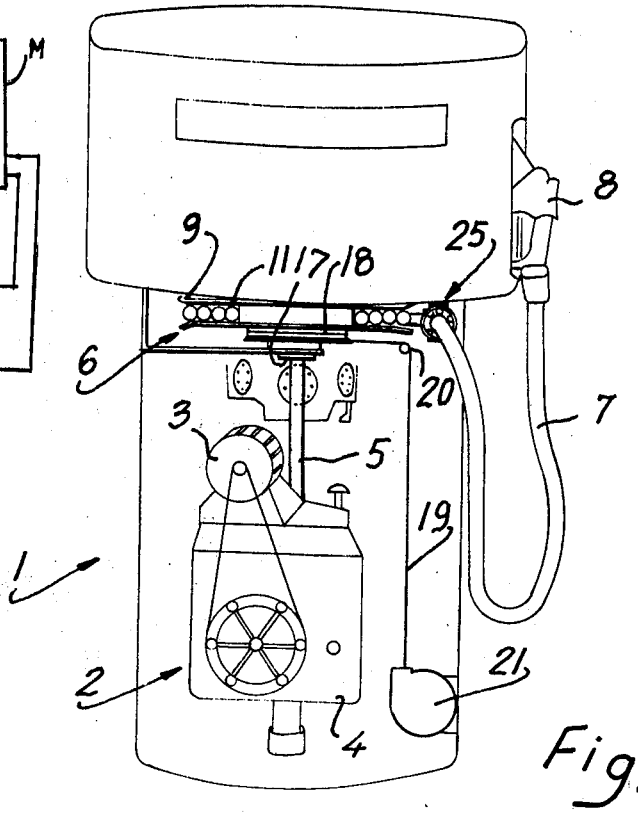
Fig. 1
Fig. 2
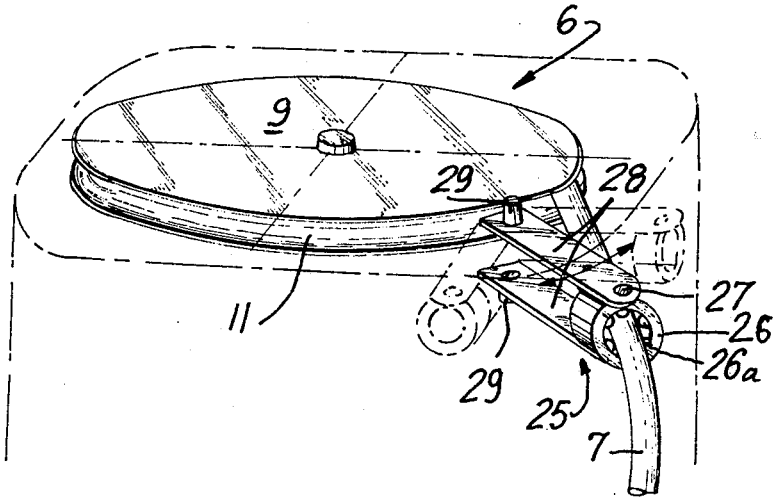

FLEXIBLE HOSE AUTOMATIC WINDING DEVICE

BACKGROUND OF THE INVENTION

There are many gasoline and other petroleum product delivery units or pumps, adapted to being used by motorists without the assistance of any particular personnel. It has been found that many individuals are careless in the manner in which they utilize the delivery units placed at their disposal in the so-called "self-service" filling stations, and particularly that they leave a substantial length of the flexible hose lying on the ground both when they fill up the fuel tank of their vehicle and when they return the delivery nozzle, provided on the end of the flexible hose, to its storage space.

Flexible hoses lying in this way on the ground wear out quickly. It often happens that vehicles run over them and they are an obstacle for unobservant predestrains, such that they have been often the source of accidents.

For remedying such disadvantages, various solutions have been proposed; particularly, it has been proposed to mount along the delivery unit or pump a flexible rod formed at its top with a loop holding the flexible hose. During use, the rod is caused to flex and then supports the hose so as to prevent it from touching the ground.

Installations have also been proposed with the hose hanging down from a suspended support and supported by rubber extensible cords of the "sandow" type. This latter arrangement requires that a very important length of flexible hose be used, thereby increasing the cost of the installation. Likewise, the delivery units or pumps are rather difficult of access and the fuel delivery pipes are of course very complex.

The efficiency of the flexible rod devices is limited since the rods often break.

The present invention obviates those various disadvantages by providing a new mechanism enabling to use only a short length of flexible hose stored inside the housing of the delivery unit itself, and, moreover, the device of the invention is such that a heavy traction need not be exerted on the hose when the delivery nozzle is used.

SUMMARY OF THE INVENTION

According to the present invention, the flexible hose automatic winding device comprises a winding drum for the flexible hose, said drum comprising a tubular shaft with a rotary gasket connected to a supply pipe for the liquid to be dispensed through the flexible hose, the drum being connected to a mechanism biasing it into rotation in the direction in which the flexible hose is wound, the torque exerted by the drum on the flexible hose keeping it under a tension which is just sufficient for the flexible hose not to come in contact with the ground.

Various other features of the invention will become apparent from the following detailed description.

BRIEF DESCRIPTION OF THE DRAWING

Embodiments of the invention are illustrated as non-limitative examples in the accompanying drawings wherein:

FIG. 1 is a schematic perspective view showing a structural example of a flexible hose automatic winding device according to the invention in combination with a gasoline delivery pump;

FIG. 1*a* is a schematic illustration of a detail of the embodiment of FIG. 1;

FIG. 2 is an enlarged perspective view of a detail of the embodiment of FIG. 1;

DETAILED DESCRIPTION OF THE PREFERRED EMBODIMENTS

Figure 3:
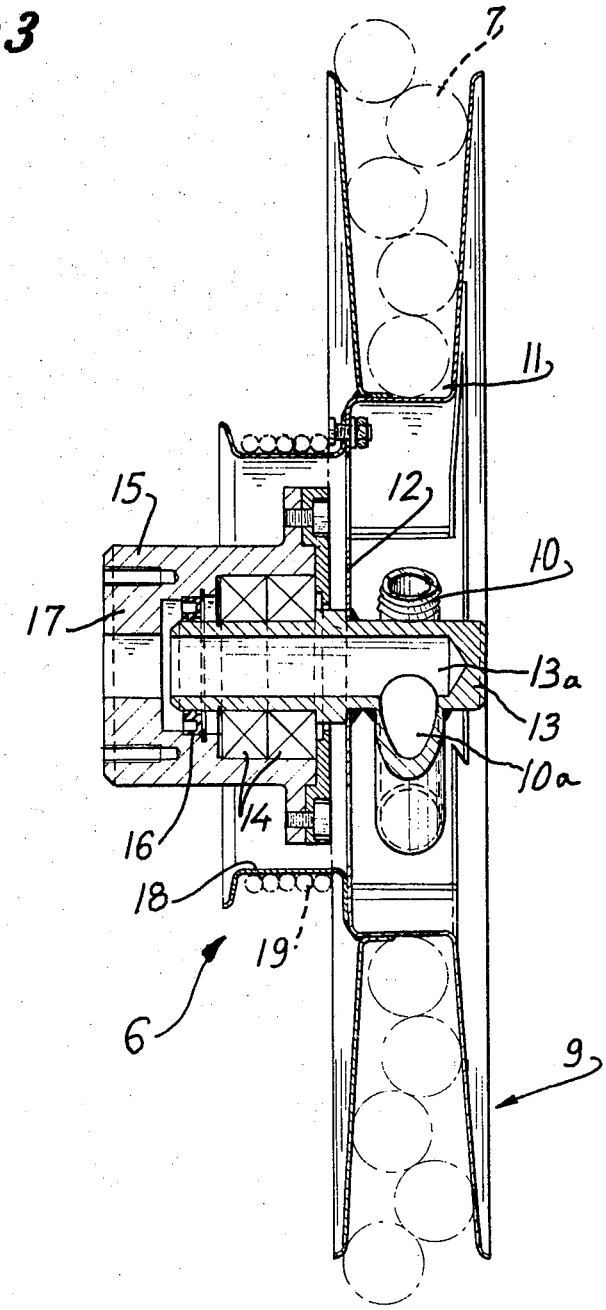
FIG. 3 is a cross-sectional view of the drum of the winding device of FIGS. 1–2.

In the drawings, reference numeral 1 generally designates a pump or supply unit for gasoline or any other petroleum product within which is mounted a pumping and metering assembly 2. The assembly 2 comprises an electrical motor 3 driving a pumping mechanism 4, and a delivery pipe 5 which is connected to the winding unit 6 of the invention. A flexible hose 7 provided with a delivery nozzle 8 is attached to the winding unit 6.

The winding unit 6 as such comprises a drum assembly 9 comprising a pulley sheave 11 on which is wound the flexible hose 7 whose end, not shown, is provided with a threaded coupling normally connected to a threaded fitting 10 (FIG. 3). The fitting 10 is disposed inside a housing formed by the hub of the pulley sheave 11 which is fastened to the drum assembly 9 through a disc 12 for rotation therewith.

The fitting 10 is formed on the outside of a tubular shaft 13 rotatably mounted in a bearing 14 which is in turn supported by a hub 15. It is advantageous that the bearing 14 be of the ball-bearing type, or of the needle-bearing type, so that the drum assembly 9 may rotate very freely relative to the support hub 15. The fitting 15 places the flexible hose 7 in fluid communication with the interior 13*a* of the tubular shaft 13 as shown at 10*a*.

A rotary sealing gasket 16 is provided between the tubular shaft 13 and the hub 15, the end of the hub 15 forming a flange 17 connected to the delivery pipe 5, FIG. 1.

The drum disc 12 supports on its other side a cylindrical pulley 18 around which is wound a cable 19. The direction of winding of the cable 19 is opposite to that of the flexible hose 7.

In the embodiment of FIG. 1, the drum assembly 9 is arranged horizontally above the supply unit 2 and the cable 19 is guided by a pulley 20 towards a traction mechanism 21.

The traction mechanism 21 may be made according to various different ways and may comprise a balancing mechanism comprising an adjustable tension spring and a connecting cable mounted on a rotatable hub, or a simple spiral calibrated spring affixed at one end to a pulley and at the other end to a fixed point. The mechanism 21 may also consist, as shown schematically at FIG. 1*a*, of an electric motor M connected to a pulley P by a sliding coupling C, the electric motor M being started by a switch 8*a* when the hose nozzle 8 is extracted from its housing and stopped by putting the nozzle 8 back in place, thus opening the switch 8*a*.

Figure 4:
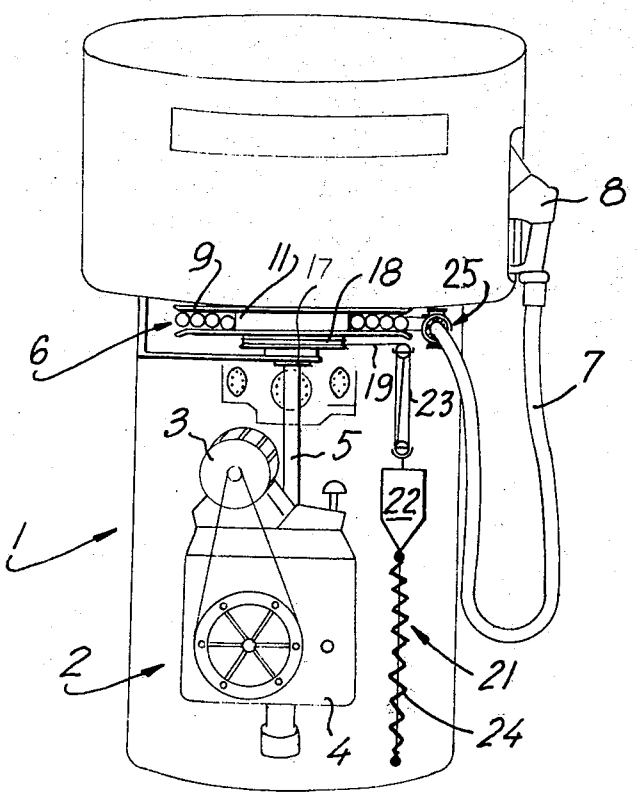

FIG. 4 shows an alternative structure for the winding mechanism 21 comprising a counterweight 22 hung to the cable 19 via a pulley-block 23. A spring 24 is provided for exerting a traction on the counterweight 22. Thus, the counterweight 22 applies a constant force on the cable 19 and therefore a constant torque on the drum 9 in the direction in which the flexible hose 7 is re-wound, and the spring 24 applies a variable component which is a function of the counterweight position, this component generating a torque which increases as a longer length of the hose 7 has been unwound from the drum 9. Thus, the portion of the flexible hose 7 unwound from the drum 9 is kept under a tension which is sufficient for preventing the unwound portion of the flexible hose 7 from rubbing against the ground, and nevertheless the traction force which must be exerted by the user of the nozzle 8 remains low.

A desirable torque depending on the length of hose 7 unwound from the drum may also be obtained when the winding mechanism 21 comprises an electric motor M, as shown at FIG. 1*a*, associated with a coupling C, or similar device, since it is possible to have the degree of coupling or the rotation speed of the motor M controlled by the extent of rotation of drum 9, for example by connecting in series in the motor input circuit a potentiometer R whose slider is operated by a feeler controlled by a cam or a spiral groove dependent from the drum and providing an indication of the extent of rotation of the drum.

Figure 5:
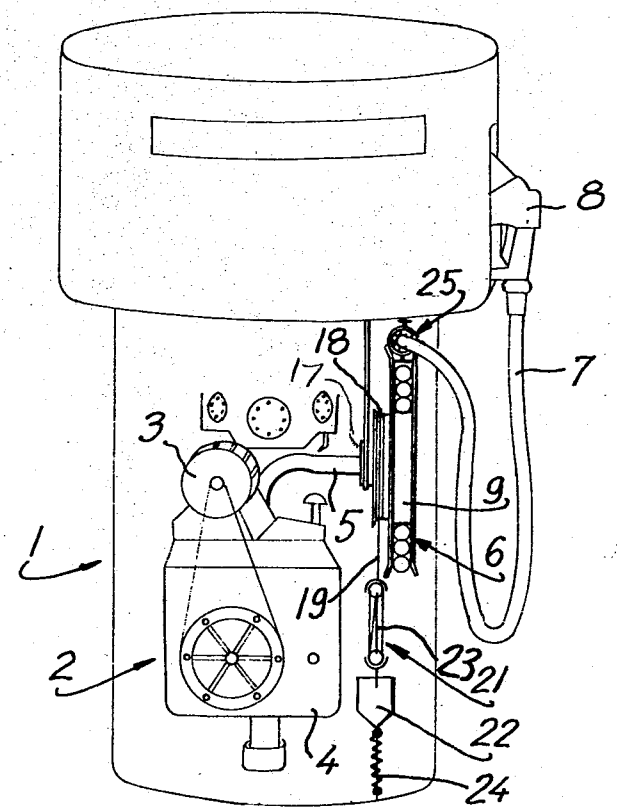
FIGS. 4 and 5 are perspective views similar to FIG. 1 and showing alternative modifications thereof.

In the hereabove description, the drum assembly 9 has been shown in a horizontal position. According to the invention, it is possible to dispose it vertically. This arrangement is illustrated at FIG. 5 showing the drum assembly 9 placed vertically, the cable 19 being as in FIG. 4 connected to a pulley-block type mechanism 23 associated with a counterweight 22 and a spring 24. In this embodiment, the winding mechanism 21 can of course be any one of the different structures discussed hereabove.

It is important that the return torque exerted by the drum assembly 9 on the flexible hose 7 be as low as possible while remaining sufficient for maintaining the hose under an appropriate tension so that it does not touch the ground. Consequently it is important to eliminate or reduce friction sources which would lead to an increase of the drum return torque.

To this end, and as shown at FIG. 2, a guide 25 is placed on the path of travel of the flexible hose 7 proximate to where it unwinds from the sheave 11 of the drum assembly 9, the guide having the shape of a socket 26 through which passes the hose 7 and in which are set balls or rollers 26*a* in rolling engagement with the peripheral surface of the hose. The socket 26 is in turn articulated via pins 27, one of which only is shown in the drawing, on pivoting arms 28 connected to the pump support frame via pins 29.

The drawings show that the arms 28 may occupy various positions according to the hose 7 being pulled in one direction or the other by a user and the guide socket 26 can also pivot so that it remains practically always in alignment with the hose which is guided by the balls or rollers 26*a*, thereby reducing friction to a minimum and maintaining the hose in the winding plane which it has to occupy in the pulley sheave 11.

It will be appreciated that the invention is not restricted to the embodiments shown and described in detail, and many modifications may be carried out without departing from its scope as defined in the claims.

I claim:

1. A flexible hose automatic winding device comprising a winding drum for the flexible hose, said drum having a shaft formed by a tubular element connected through a rotary sealing gasket to a supply-pipe of a liquid to be dispensed by the flexible hose, and biasing means urging said drum in rotation in the direction in which the flexible hose is wound, said biasing means exerting a torque on said drum maintaining the flexible hose under a tension just sufficient to prevent the flexible hose from coming in contact with the ground, wherein said biasing means comprises a pulley rigidly connected to said drum, a cable wound on said pulley in a direction opposite to the direction of winding of the flexible hose, and means exerting a progressive pulling force on the end of said cable for applying to said pulley a progressively increasing torque as a function of the amount of unwinding of the flexible hose from said drum.

2. The device of claim 1 wherein said means exerting a pulling force on the end of said cable comprises a counterweight attached to the end of said cable and a pulley block arrangement disposed between said counterweight and said pulley, said cable being wound through said pulley block arrangement.

3. The device of claim 2 further comprising a spring exerting a pulling force on said counterweight attached to the end of said cable.

4. The device of claim 1 wherein said means exerting a pulling force on the end of said cable comprises a second pulley attached to the end of said cable for winding of said cable around said second pulley, an electric motor, switching means for starting said electric motor when the flexible hose is removed from an inoperative position to an operative position and for stopping said motor when said flexible hose is returned to said inoperative position, and sliding coupling means between said motor and said second pulley.

5. The device of claim 4 wherein said flexible hose has a dispensing nozzle on one end, said switching means being closed when said nozzle is removed from said inoperative position.

6. The device of claim 1 further comprising a friction reducing guide for the flexible hose, said guide being disposed at a predetermined position proximate said drum in the plane of unwinding of the flexible hose.

7. The device of claim 6 wherein said guide comprises a socket through which the flexible hose is passed, rolling bearing means disposed in said socket in engagement with the flexible hose, and pivotable arm means pivotably supporting said socket.

8. The device of claim 1 wherein said drum is disposed horizontally.

9. The device of claim 1 wherein said drum is disposed vertically.

* * * * *

UNITED STATES PATENT AND TRADEMARK OFFICE

CERTIFICATE OF CORRECTION

PATENT NO. : 4,305,553

DATED : December 15, 1981

INVENTOR(S) : Michel Jacques Leon Coquerel

It is certified that error appears in the above-identified patent and that said Letters Patent are hereby corrected as shown below:

Col. 1, lines 20-21, correct the spelling of --pedestrians--.

Col. 2, line 35, change "15" (second occurrence) to --10--.

Signed and Sealed this

*First* Day of *June 1982*

[SEAL]

*Attest:*

GERALD J. MOSSINGHOFF

*Attesting Officer*

*Commissioner of Patents and Trademarks*